US009120317B2

(12) United States Patent
Ito

(10) Patent No.: US 9,120,317 B2
(45) Date of Patent: Sep. 1, 2015

(54) LIQUID JETTING APPARATUS

(71) Applicant: Takashi Ito, Nagoya (JP)

(72) Inventor: Takashi Ito, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/220,808

(22) Filed: Mar. 20, 2014

(65) Prior Publication Data

US 2014/0292917 A1 Oct. 2, 2014

(30) Foreign Application Priority Data

Mar. 27, 2013 (JP) ..... 2013-065712

(51) Int. Cl.
*B41J 2/165* (2006.01)

(52) U.S. Cl.
CPC ..... *B41J 2/16538* (2013.01)

(58) Field of Classification Search
USPC ..... 347/33
See application file for complete search history.

(56) References Cited

U.S. PATENT DOCUMENTS

| | | | | |
|---|---|---|---|---|
| 5,969,731 | A * | 10/1999 | Michael et al. | 347/33 |
| 6,340,219 | B1 | 1/2002 | Kumagai et al. | |
| 6,547,369 | B1 * | 4/2003 | Temple | 347/33 |
| 2002/0171707 | A1 * | 11/2002 | Ara | 347/33 |

FOREIGN PATENT DOCUMENTS

| | | |
|---|---|---|
| JP | 2007-230033 | 9/2007 |
| JP | 4277156 | 3/2009 |

* cited by examiner

*Primary Examiner* — Stephen Meier
*Assistant Examiner* — Alexander D Shenderov
(74) *Attorney, Agent, or Firm* — Frommer Lawrence & Haug LLP

(57) ABSTRACT

A liquid jetting apparatus includes a liquid jetting head having a liquid jetting surface formed with nozzles, a wiping unit wiping the liquid jetting surface of the liquid jetting head, and a drive section configured to move at least one of the wiping unit and the liquid jetting head such that the wiping unit moves relative to the liquid jetting head toward one side in a predetermined direction along the liquid jetting surface. The wiping unit has a first wiping portion and a second wiping portion which are arranged in the predetermined direction with an interval therebetween, and each of which has a leading end configured to contact with the liquid jetting surface, and extends in a direction intersecting the liquid jetting surface, and the leading end of the first wiping portion has a greater surface roughness than that of the leading end of the second wiping portion.

12 Claims, 11 Drawing Sheets

LIQUID JETTING APPARATUS

CROSS REFERENCE TO RELATED APPLICATION

The present application claims priority from Japanese Patent Application No. 2013-065712, filed on Mar. 27, 2013, the disclosure of which is incorporated herein by reference in its entirety.

BACKGROUND OF THE INVENTION

1. Field of the Invention

The present invention relates to a liquid jetting apparatus.

2. Description of the Related Art

As an example of liquid jetting apparatuses which jet liquids, there is known such a liquid jetting apparatus including a mechanism which removes foreign substances and the like adhering to a liquid jetting surface formed with nozzles. For example, as a mechanism which wipes the ink jetting surface (nozzle formation surface) of an ink jet head, there is known a wiping unit capable of both removal operations of removing the ink adhering to the ink jetting surface and removing the foreign substances adhered to the ink jetting surface.

The above wiping unit has a wiping member pressed against the ink jetting surface. The wiping member is made from a composite material which conjoins a wiping material formed of an elastic plate such as rubber on one side, and a rubbing material such as felt on the other side. By moving in one direction relative to the ink jetting surface, the wiping member causes the wiping material to wipe away the ink adhering to the ink jetting surface. Further, by moving in the direction opposite to the one direction relative to the ink jetting surface, the wiping member causes the rubbing material to rub away the foreign substances adhered to the ink jetting surface.

However, in the above wiping unit, when removing the foreign substances on the ink jetting surface with the rubbing material, the ink jetting surface can be wiped only once by one movement of the wiping member. Therefore, in such cases where any paper powder (paper fiber) is stuck in some nozzles, and/or where any solidified ink adheres to the ink jetting surface, it is not easy to remove those foreign substances.

SUMMARY OF THE INVENTION

An object of the present invention is to provide a liquid jetting apparatus capable of removing any foreign substances adhering to the liquid jetting surface of a liquid jetting head more reliably.

According to an aspect of the present invention, there is provided a liquid jetting apparatus including: a liquid jetting head having a liquid jetting surface in which a nozzle is formed; a wiping unit configured to wipe the liquid jetting surface of the liquid jetting head; and a drive section configured to move at least one of the wiping unit and the liquid jetting head such that the wiping unit moves relative to the liquid jetting head toward one side in a predetermined direction along the liquid jetting surface, wherein the wiping unit has a first wiping portion and a second wiping portion which are arranged in the predetermined direction with an interval therebetween, and each of which has a leading end configured to contact with the liquid jetting surface and extends in a direction intersecting the liquid jetting surface, and the leading end of the first wiping portion has a greater surface roughness than that of the leading end of the second wiping portion.

In the liquid jetting apparatus according to the above aspect of the present invention, the wiping unit has two wiping portions. Therefore, when the wiping unit moves once along the liquid jetting surface, the two wiping portions wipe the liquid jetting surface twice successively. Hence, it becomes easier to remove foreign substances adhering to the liquid jetting surface. Further, if some large foreign substances adhere to the liquid jetting surface, then it is preferable to remove the foreign substances by capturing the same with the wiping portion of large roughness in the asperity formed in the surface. However, if there is only the wiping portion of large surface roughness, then it is difficult to remove those foreign substances smaller in size than the asperity of the surface. In the wiping unit of the liquid jetting apparatus according to the above aspect of the present invention, however, the leading ends of the two wiping portions are different in surface roughness. Thus, while large foreign substances are removed by the first wiping portion of the greater surface roughness, small foreign substances can still be removed reliably by the second wiping portion of the smaller surface roughness.

DESCRIPTION OF THE PREFERRED EMBODIMENT

Next, a preferred embodiment of the present invention will be explained. This embodiment is one example applying the present invention to an ink jet printer which records images and the like by jetting ink to a sheet of recording paper transported in a predetermined transport direction. Further, hereinbelow, the near side of the page of FIG. 1 is defined as the upper side, the far side of the page as the lower side, and the left-right direction (paper width direction) of FIG. 1 is defined as the left-right direction of the printer, while directional terms such as "up", "down", "left", and "right" are used as appropriate in the explanation.

<Schematic Configuration of the Printer>

Figure 1:
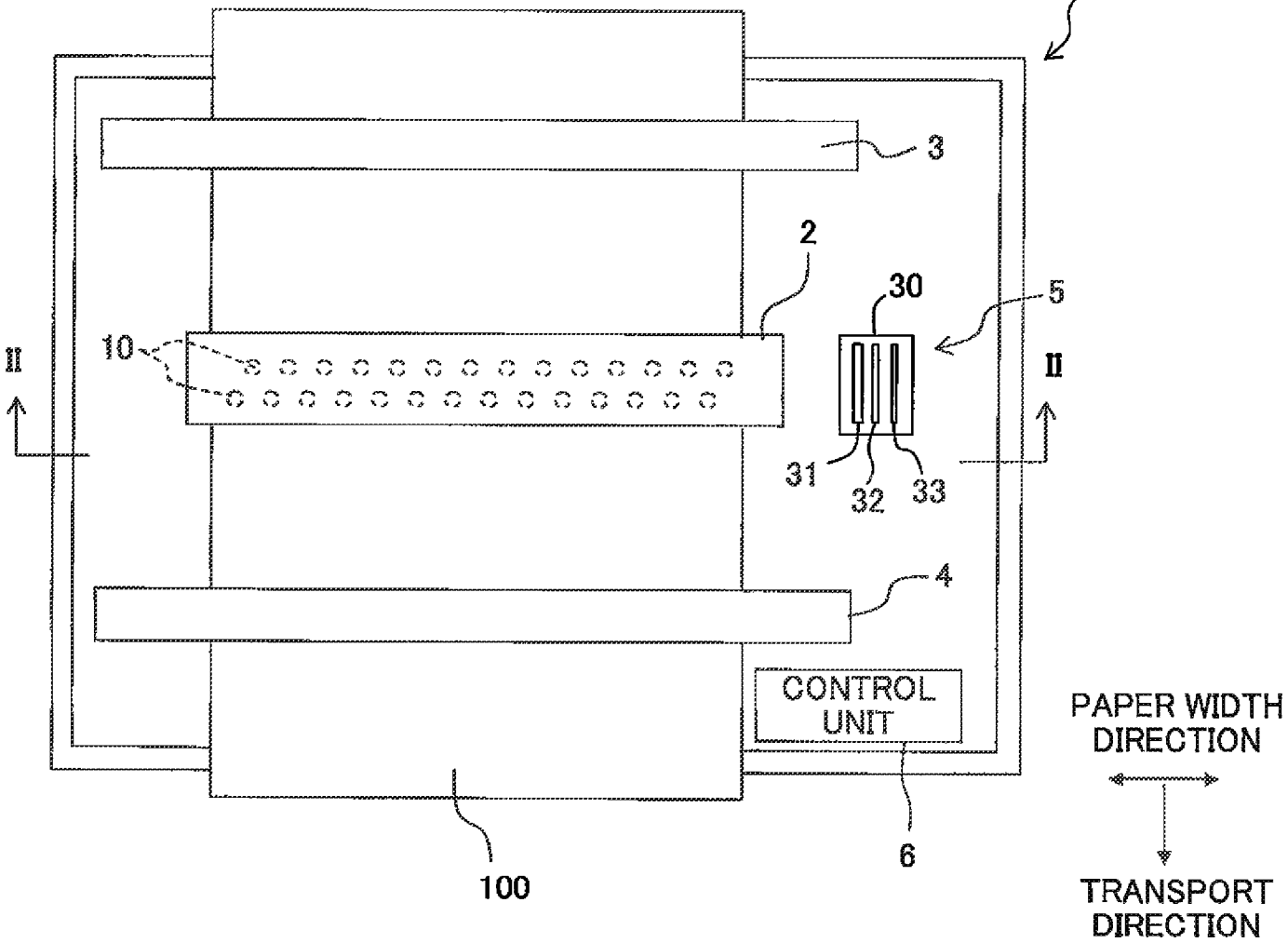
FIG. 1 is a schematic plan view of a printer according to an embodiment of the present invention.
Figure 2:
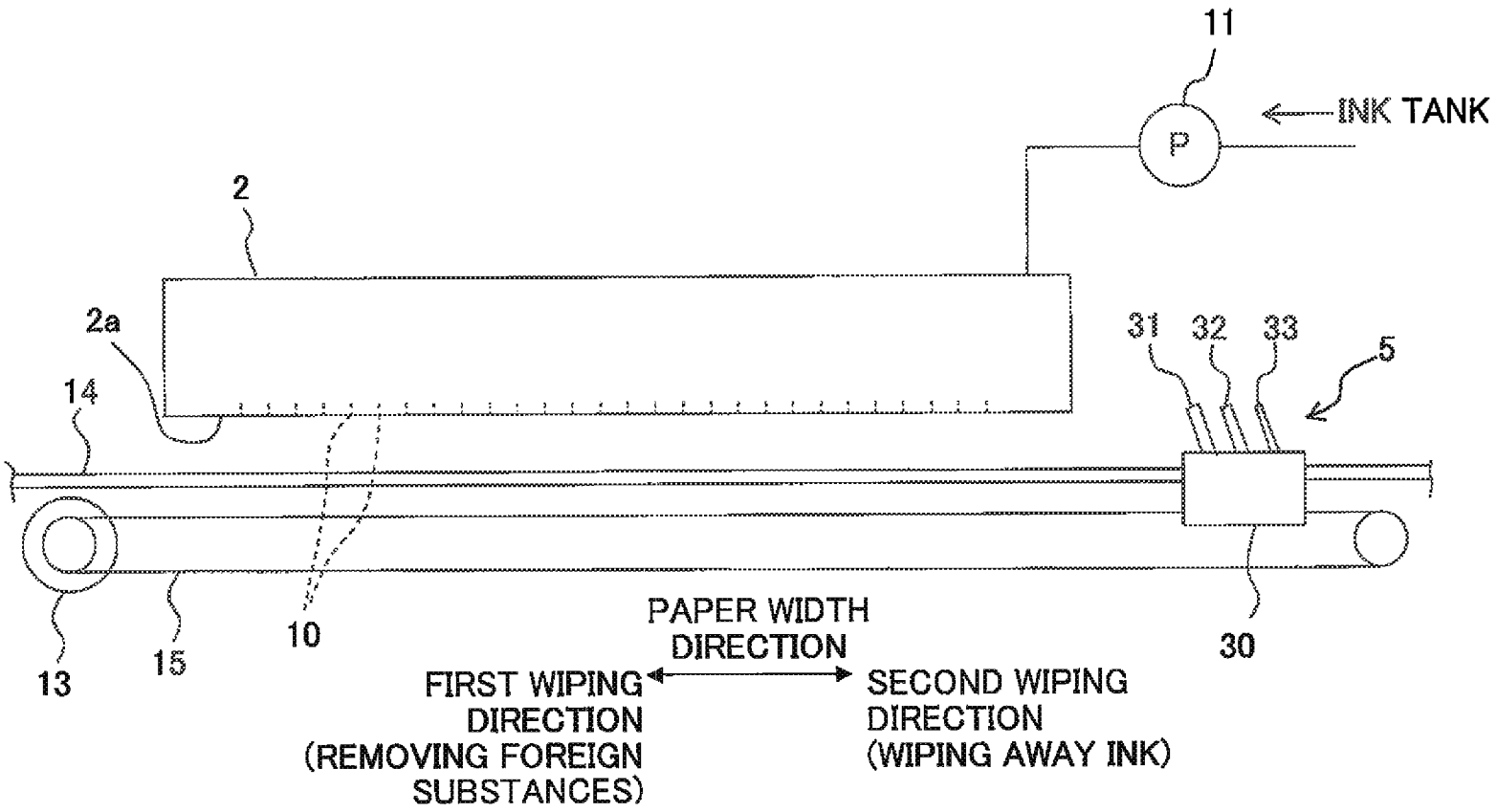
FIG. 2 is an arrow view along the line II-II of FIG. 1.
Figure 3:
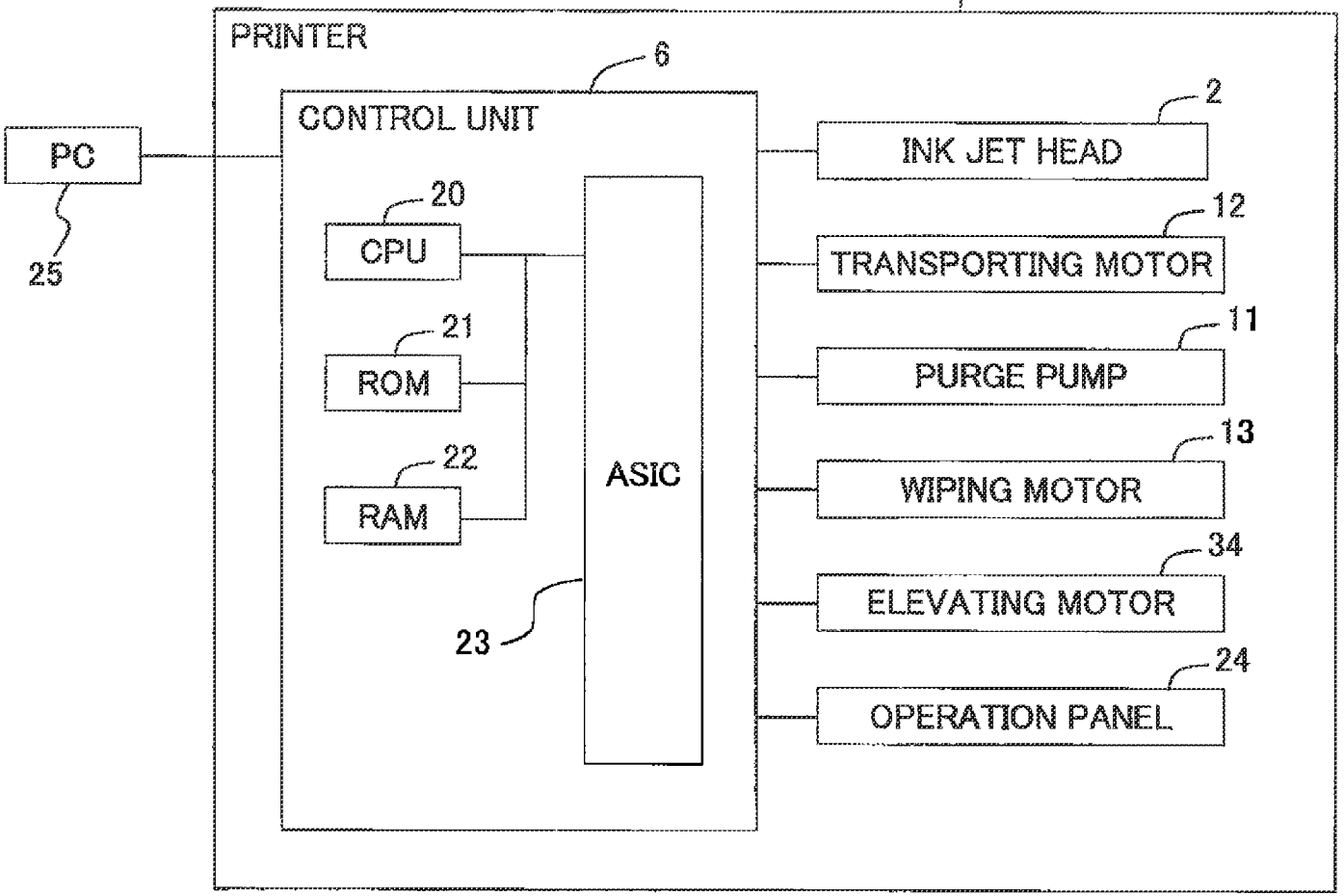
FIG. 3 is a block diagram schematically showing an electrical configuration of the printer.

As shown in FIGS. 1 to 3, a printer 1 includes an ink jet head 2, two transport rollers 3 and 4, a wiping unit 5, a control unit 6, etc.

The ink jet head 2 (the liquid jetting head of the present invention) is a line head elongated in the paper width direction. The ink jet head 2 is connected with an unshown ink tank to be supplied with ink from the ink tank. On the lower surface of the ink jet head 2 and along its longitudinal direction (the paper width direction), a plurality of nozzles 10 are formed to align in two rows. Hereinbelow, the lower surface of the ink jet head 2, on which the plurality of nozzles 10 are formed, will be referred to as an ink jetting surface 2*a* (the liquid jetting surface of the present invention).

The two transport rollers 3 and 4 are arranged to sandwich the ink jet head 2 in a direction (the transport direction) orthogonal to the longitudinal direction of the ink jet head 2. These two transport rollers 3 and 4 are driven to rotate synchronously by a transporting motor 12 (see FIG. 3) to transport a sheet of recording paper 100.

The ink jet head 2 prints desired characters, images and the like on the recording paper 100 by jetting the ink from each of the plurality of nozzles 10 of the ink jetting surface 2*a* to the recording paper 100 transported in the transport direction by the two transport rollers 3 and 4.

Further, as shown in FIG. 2, a purge pump 11 is arranged between the ink jet head 2, and the ink tank (not shown). This purge pump 11 is used to forcibly discharge the ink from the plurality of nozzles 10 of the ink jet head 2 by way of pressurizing the ink from the ink tank and supplying the same to the ink jet head 2 (this operation is referred to as purge). Through the purge, because the foreign substances and air mixed into the ink jet head 2 are discharged, as well as the dried and thickened ink, etc., it is possible to eliminate any jet defection of the nozzles 10, or to prevent any jet defection from occurring. Further, the ink discharged from the plurality of nozzles 10 through the purge is collected by an unshown waste-ink reception member arranged below the plane over which the recording paper 100 is transported.

The wiping unit 5 wipes the ink jetting surface 2*a* of the ink jet head 2 to remove the foreign substances adhering to the ink jetting surface 2*a*, and to remove the ink adhering to the ink jetting surface 2*a*, respectively. The foreign substances adhering to the ink jetting surface 2*a* may include paper powder (paper fiber) stuck in the nozzles 10 of the ink jetting surface 2*a*, solidified ink clinging to the ink jetting surface 2*a*, etc. By causing the wiping unit 5 to wipe the ink jetting surface 2*a*, such foreign substances as mentioned above are removed from the ink jetting surface 2*a*. Further, after the aforementioned purge is carried out, because some of the ink discharged from the nozzles 10 has still adhered to the ink jetting surface 2*a*, the wiping unit 5 wipes away the ink adhering to the jet surface 2*a*. The wiping unit 5 has three wiping members 31, 32 and 33 aligning in the paper width direction, and a holding member 30 holding these three wiping members 31 to 33. Further, the holding member 30 is also provided with an elevating motor 34 (see FIG. 3) to raise and lower the three wiping members 31 to 33 relative to the holding member 30. By virtue of the elevating motor 34, it is possible to adjust the up-down position of the three wiping members 31 to 33. A specific configuration of the three wiping members 31 to 33 will be explained later.

The wiping unit 5 is configured to be movable in the paper width direction. As shown in FIG. 2, the holding member 30 of the wiping unit 5 is fitted on a guide rail 14 extending in the paper width direction. Further, the holding member 30 is coupled with an endless belt 15 connected to a wiping motor 13. Then, as the wiping motor 13 drives the endless belt 15 to run, the wiping unit 5 moves in the paper width direction along the guide rail 14. Further, by switching the rotary direction of the wiping motor 13, it is possible to cause the wiping unit 5 to move in two directions, i.e., the leftward direction (first wiping direction) and the rightward direction (second wiping direction), and to wipe the ink jetting surface 2*a* in each movement.

Further, the configuration of moving the wiping unit 5 is not limited to that of FIG. 2. For example, it is also configurable to move the wiping unit 5 in the paper width direction by coupling the holding member 30 with a screw shaft extending in the paper width direction in a screw-coupling manner, and then causing the wiping motor 13 to drive this screw shaft to rotate.

As shown in FIGS. 1 and 2, the wiping unit 5 stands by in a position on the right side of the ink jet head 2 when it does not carry out the wiping of the ink jetting surface 2*a*. If the wiping unit 5 moves in the paper width direction from the standby state, then the leading ends of the three wiping members 31 to 33 come to contact with the ink jetting surface 2*a*, and in the contacted state, move relative to the ink jetting surface 2*a* so as to wipe away the foreign substances and ink adhered to the ink jetting surface 2*a* (see FIGS. 6 and 7). The wiping operation of the wiping unit 5 will be explained later in detail.

As shown in FIG. 3, the control unit 6 includes a CPU (Central Processing Unit) 20, a ROM (Read Only Memory) 21, a RAM (Random Access Memory) 22, an ASIC (Application Specific Integrated Circuit) 23 including various control circuits, etc. The control unit 6 is connected with the ink jet head 2, transporting motor 12, purge pump 11, wiping motor 13, and elevating motor 34. Further, the control unit 6 is also connected with an operation panel 24, a PC 25 which is an external device, etc.

The control unit 6 causes the CPU 20 and the ASIC 23 to carry out various processes according to programs stored in the ROM 21. To give an example, based on a print command sent from the PC 25, the control unit 6 controls the ink jet head 2 and the transporting motor 12 to print images and the like on the recording paper 100. Further, it controls the purge pump 11 to carry out the purge of the ink jet head 2. Further, it controls the elevating motor 34 and the wiping motor 13 to cause the wiping unit 5 to carry out the wiping of the ink jetting surface 2*a* of the ink jet head 2.

Further, although the control unit 6 causes the CPU 20 and the ASIC 23 to carry out various processes in the above example, the present invention is not limited to this. The control unit 6 may also be realized by any other hardware construction. For example, only a CPU or only an ASIC may also carry out the processes. Further, the function may also be shared and realized by two or more CPUs and/or two or more ASICs.

<Details of the Wiping Unit>

Next, a detailed explanation will be given about the configuration of the three wiping members 31 to 33 of the wiping unit 5 (the first wiping member 31, second wiping member 32 and third wiping member 33). Each of the three wiping members 31 to 33 is a plate-like member formed of an elastic material such as rubber, and is held by the holding member 30 in a posture intersecting the ink jetting surface 2*a*. In more detail, the three wiping members 31 to 33 extend in a direction inclined to the left side with respect to the up-down direction orthogonal to the ink jetting surface 2*a*.

Figure 4:
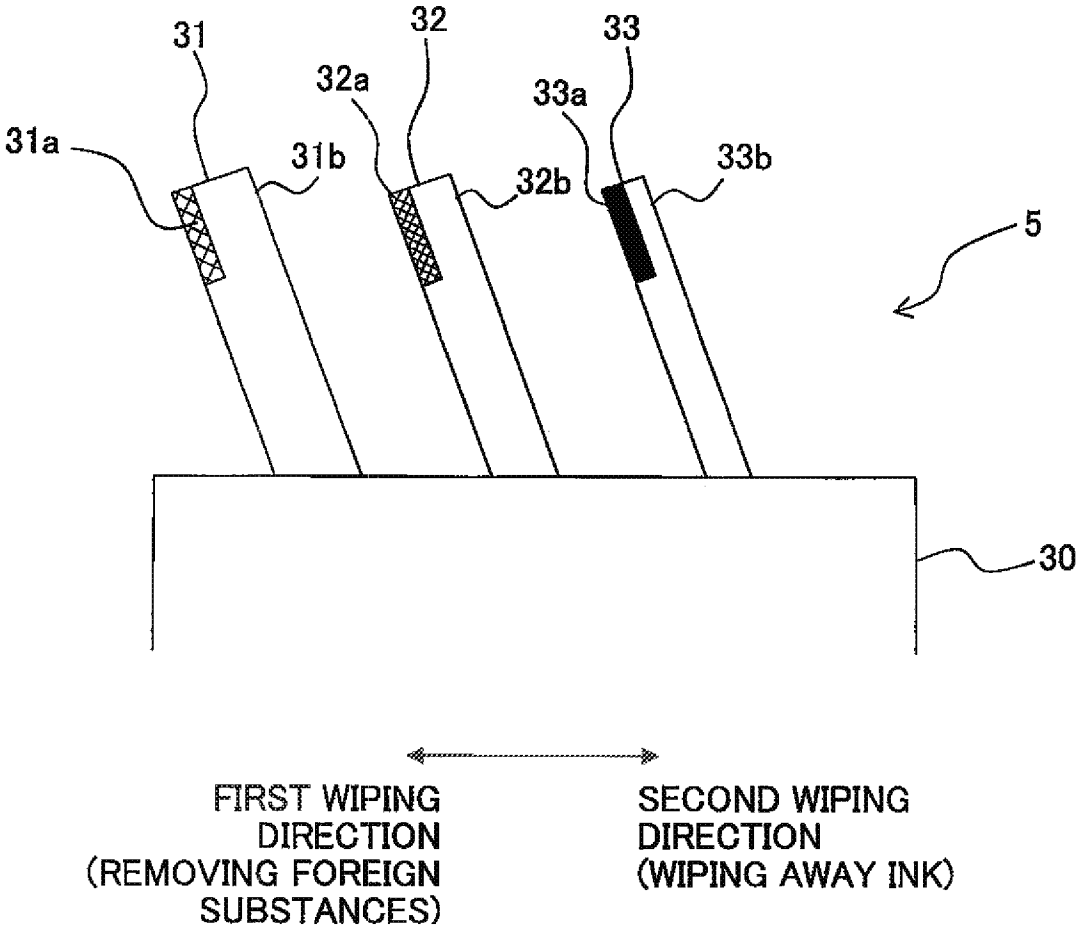
FIG. 4 is a lateral view of three wiping members of a wiping unit.

As shown in FIGS. 1, 2 and 4, the three wiping members 31 to 33 are arranged in the paper width direction with intervals therebetween in order from one side (left side) in the paper width direction according to the sequence of the first wiping member 31, the second wiping member 32 and the third wiping member 33. The intervals between the three wiping members 31 to 33 are taken as the interspaces as distant as there is no interference with each other when each of the leading ends is flexed by contact with the ink jetting surface 2*a* (see FIGS. 8A and 8B). Further, as shown in FIG. 4, in a state that the three wiping members 31 to 33 are not in contact with the ink jetting surface 2*a*, leading ends of the three wiping members 31 to 33 are positioned at the same height in the up-down direction.

Further, by attaching the three wiping members 31 to 33 to the one holding member 30, these three wiping members 31 to 33 are connected to each other, and thus it is possible for the one wiping motor 13 to move the wiping members 31 to 33 as a whole. That is, the holding member 30 of this embodiment corresponds to the "connection portion" of the present invention.

The first wiping member 31 has a first rough surface 31*a* in the left lateral surface of its leading end, and has a first smooth surface 31*b* in the right lateral surface of its leading end. That is, the first rough surface 31*a* faces the left side, while the first smooth surface 31*b* faces the right side. The first rough surface 31*a* has a surface roughness greater than that of the first smooth surface 31*b*.

Further, the second wiping member 32 has a second rough surface 32*a* in the left lateral surface of its leading end, and has a second smooth surface 32*b* in the right lateral surface of its leading end. That is, the second rough surface 32*a* faces the left side, while the second smooth surface 32*b* faces the right side. Further, the second rough surface 32*a* has a surface roughness greater than that of the second smooth surface 32*b*.

Likewise, the third wiping member 33 has a third rough surface 33*a* in the left lateral surface of its leading end, and has a third smooth surface 33*b* in the right lateral surface of its leading end. That is, the third rough surface 33*a* faces the left side, while the third smooth surface 33*b* faces the right side. Further, the third rough surface 33*a* has a surface roughness greater than that of the third smooth surface 33*b*.

Further, comparing the surface roughness Ra1 of the first rough surface 31*a*, the surface roughness Ra2 of the second rough surface 32*a* and the surface roughness Ra3 of the third rough surface 33*a*, the result is Ra1>Ra2>Ra3. That is, among the three rough surfaces 31*a*, 32*a* and 33*a*, the more leftward the one is positioned, the greater its surface roughness becomes. Further, almost the same magnitude of surface roughness is shared among the surface roughness Rb1 of the first smooth surface 31*b*, the surface roughness Rb2 of the second smooth surface 32*b* and the surface roughness Rb3 of the third smooth surface 33*b*. To organize a relationship between the magnitudes of the above surface roughness, the result is: Ra1 (of the first rough surface 31*a*)>Ra2 (of the second rough surface 32*a*)>Ra3 (of the third rough surface 33*a*)>Rb1 (of the first smooth surface 31*b*)=Rb2 (of the second smooth surface 32*b*)=Rb3 (of the third smooth surface 33*b*).

Figure 5A:
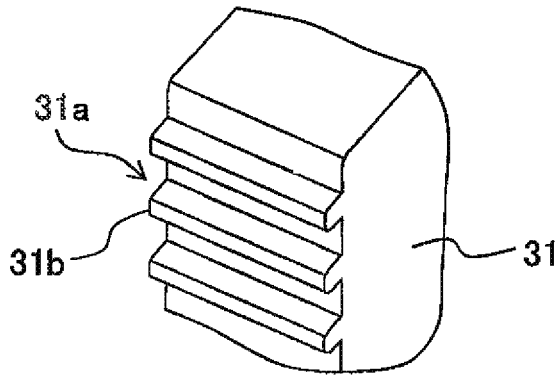
FIGS. 5A to 5C are enlarged views of rough surfaces.
Figure 5B:
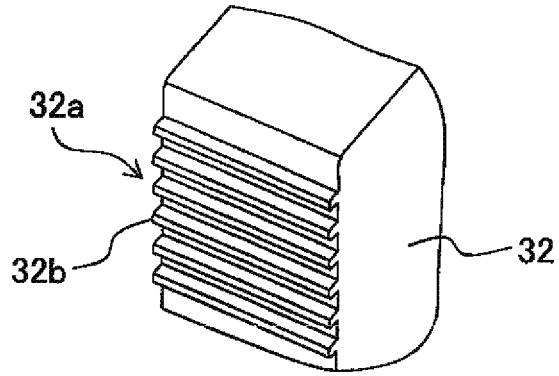
Figure 5C:
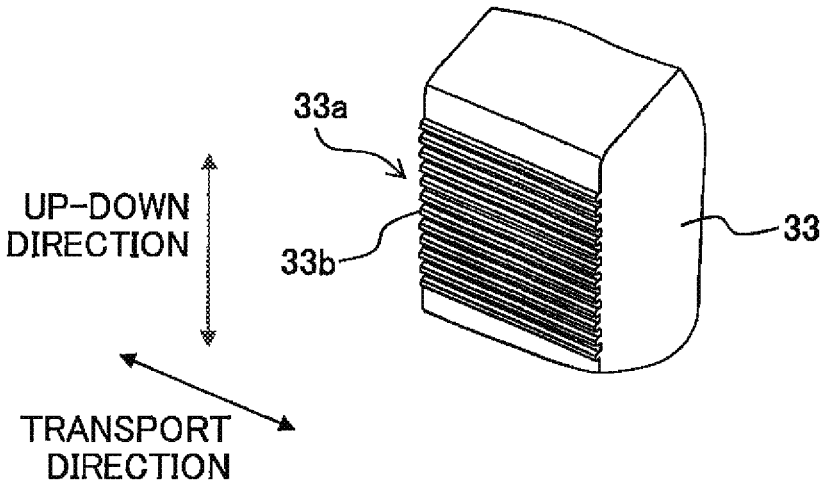

While there is no specific limitation on concavo-convex shape of the surfaces of the rough surfaces 31*a*, 32*a* and 33*a*, an example is given in FIGS. 5A to 5C. The three rough surfaces 31*a*, 32*a* and 33*a* are, as shown in FIGS. 5A to 5C, formed respectively of a plurality of projections 31*b*, projections 32*b* and projections 33*b* each extending in the transport direction and aligned in the up-down direction. As the surface roughness of the rough surfaces becomes greater, the projective amount of the projections becomes greater and the arrangement interval for the projections becomes longer. That is, among the three rough surfaces 31*a*, 32*a* and 33*a*, the projections 31*b* of the first rough surface 31*a* of the greatest surface roughness have the greatest projective amount, and the arrangement interval for the projections 31*b* is the longest.

Further, as a method of forming a plurality of portions different from each other in surface roughness as mentioned above, for example, in the case of molding the wiping members 31 to 33 via mold injection, a change is applied beforehand to the inside roughness of the metallic mold in the places for molding the leading ends of the wiping members 31 to 33. Further, it is also possible to adopt a publicly-known rough surface treatment or mirror-like finishing such as laser processing, polishing processing, etc. Alternatively, the rough surfaces and the like may also be formed by applying sheets or the like formed of a material of different surface roughness.

Further, with respect to this embodiment, each of a combination of the first wiping member 31 and second wiping member 32, a combination of the first wiping member 31 and third wiping member 33, and a combination of the second wiping member 32 and third wiping member 33 corresponds to the "first wiping portion" or "second wiping portion" of the present invention.

As shown in FIG. 4, flexural rigidity (i.e., difficulty to bend) is also different between the three wiping members 31 to 33. In particular, the thickness of the first wiping member 31 is greatest, the thickness of the second wiping member 32 is intermediate, and the thickness of the third wiping member 33 is smallest. Further, the flexural rigidity is expressed by the product of an elastic coefficient E and a sectional second moment I. In order to vary the flexural rigidity of the three wiping members 31 to 33, other than varying the thickness, as mentioned above, so as to vary the sectional second moment I, it is also possible to vary the material of the three wiping members 31 to 33 so as to vary the elastic coefficient E. For example, three types of rubber different in hardness may be used to form the three wiping members 31 to 33, respectively.

Next, an explanation will be given about an operation of wiping the ink jetting surface 2*a* by the wiping unit 5.

Figure 6:
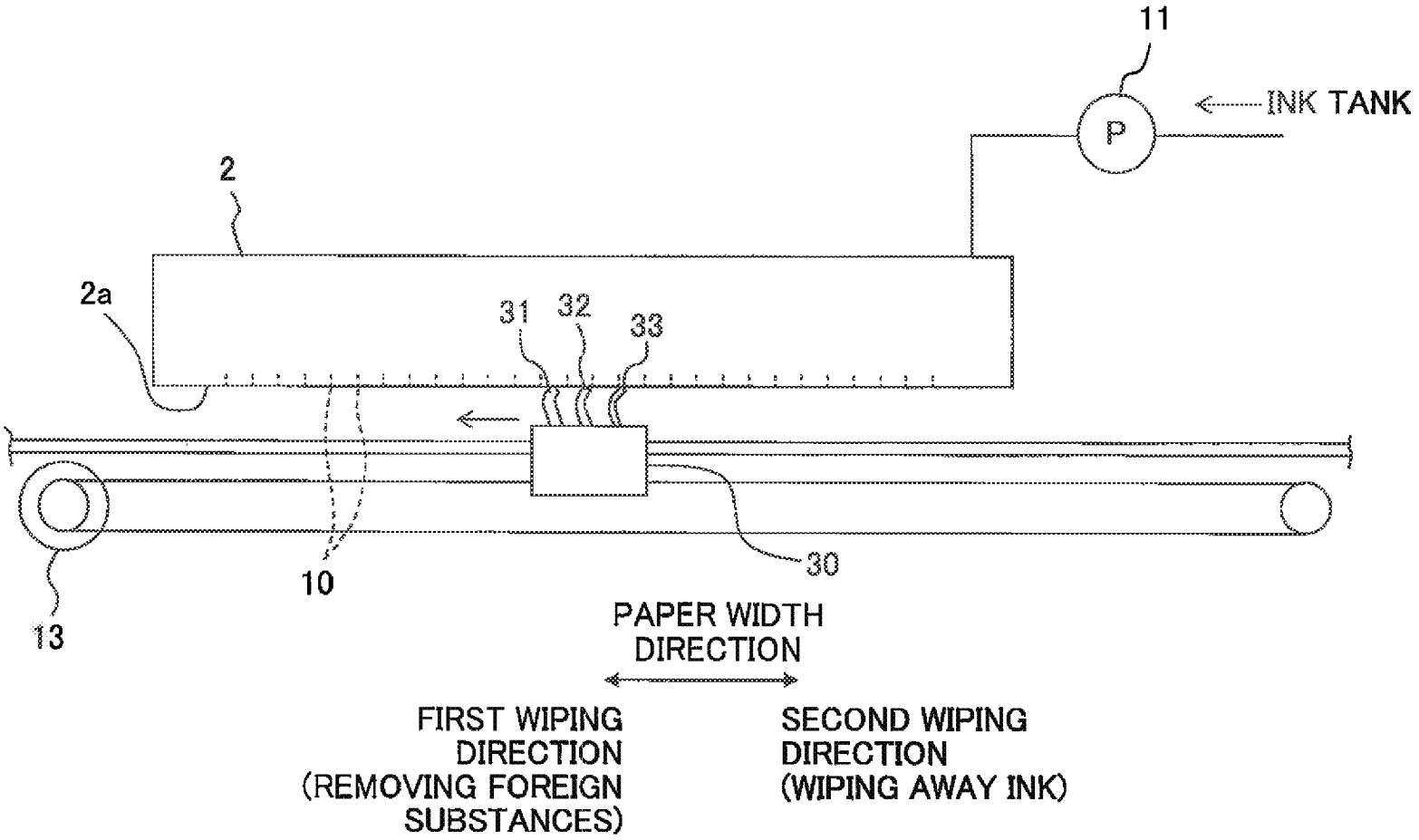
FIG. 6 shows a first wiping operation of the wiping unit for removing foreign substances.
Figure 7:
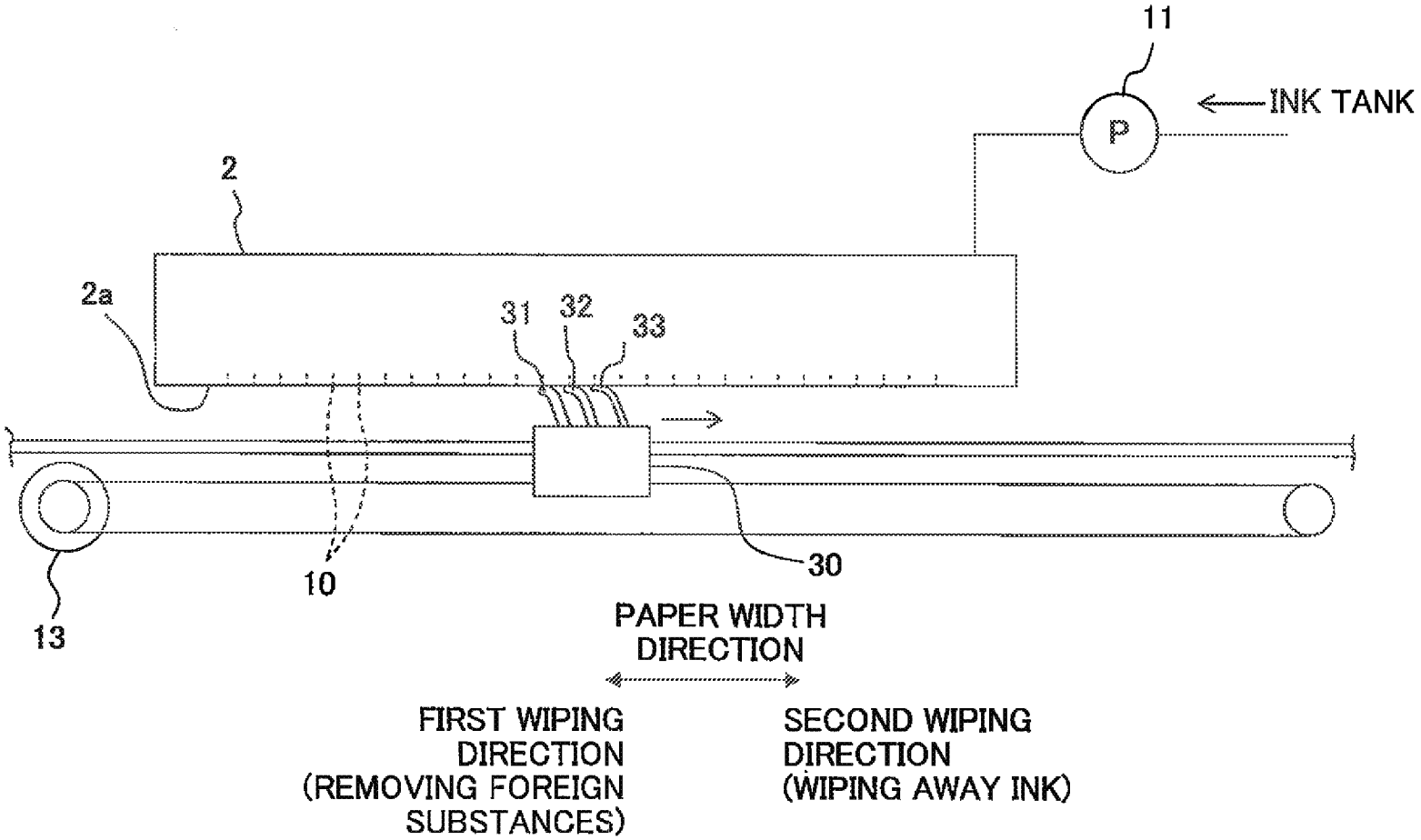
FIG. 7 shows a second wiping operation of the wiping unit for wiping away ink.

As shown in FIG. 2, with the wiping unit 5 in a standby state (without contact with the ink jetting surface 2*a*), the leading ends of the three wiping members 31 to 33 are positioned above the plane including the ink jetting surface 2*a*. Then, as shown in FIGS. 6 and 7, when the wiping unit 5 has been moved in the paper width direction to the ink jetting surface 2*a*, the three wiping members 31 to 33 move with the leading ends being pressed against the ink jetting surface 2*a* and flexed to wipe the ink jetting surface 2*a*.

<First Wiping Operation>

Figure 8A:
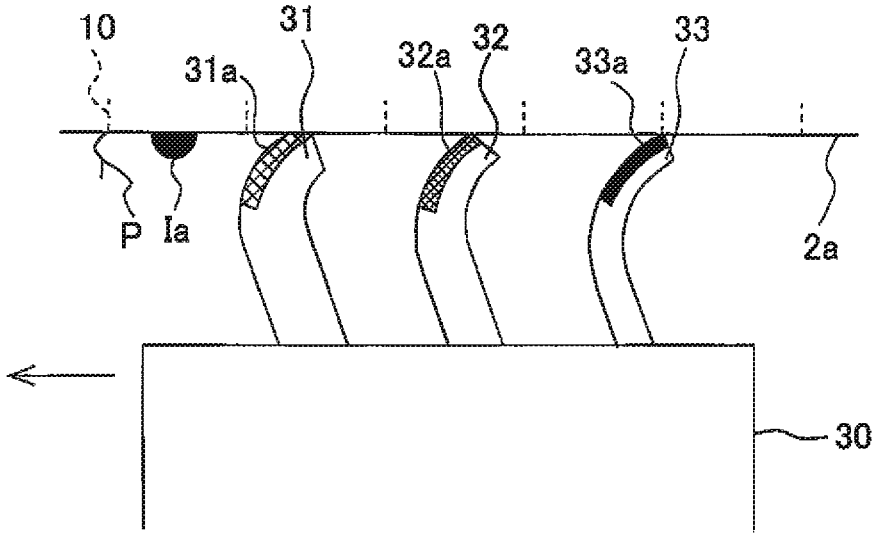
FIG. 8A shows states of the wiping members in the first wiping operation and FIG. 8B shows states of the wiping members in the second wiping operation.

Now, an explanation will be given about a first wiping operation of the wiping unit 5 to remove the foreign substances adhered to the ink jetting surface 2*a*. The control unit 6 controls the wiping motor 13 to move the wiping unit 5 to one side in the paper width direction (the left side; also referred to as first wiping direction). On this occasion, as shown in FIGS. 6 and 8A, the three wiping members 31 to 33 are each flexed, and the left lateral surfaces of their leading ends are in contact with the ink jetting surface 2*a*. Remaining in this state, the wiping unit 5 is moved in the first wiping direction along the ink jetting surface 2*a*.

The first rough surface 31*a*, second rough surface 32*a* and third rough surface 33*a* of greate surface roughness are formed in the left lateral surfaces of the three wiping members 31 to 33, respectively. When the three wiping members 31 to 33 wipe the ink jetting surface 2*a* while moving in the first wiping direction, because the three rough surfaces 31*a* to 33*a* move while in contact with the ink jetting surface 2*a*, they can wipe away and remove paper powder P, clung ink Ia and the like adhering to the ink jetting surface 2*a*. Further, as the wiping unit 5 moves once relative to the ink jetting surface 2*a*, the three wiping members 31 to 33 wipe the ink jetting surface 2*a* three times successively. At that rate, therefore, the foreign substances are easier to remove.

Further, if some large foreign substances adhere to the ink jetting surface 2*a*, then it is preferable to wipe with a wiping member of large surface roughness, and then remove the foreign substances by capturing the same with the asperity formed in the surface. However, if there is only a wiping member of large surface roughness, then it is difficult to remove those foreign substances smaller in size than the asperity of the surface. In this respect, therefore, the rough surfaces 31*a* to 33*a* of the three wiping members 31 to 33 are different in surface roughness in this embodiment. Thus, while large foreign substances are removed by the first wiping member 31 of the greater surface roughness, small foreign substances can be removed by the second wiping member 32 and third wiping member 33 of the smaller surface roughness.

Further, in a state that the ink jetting surface 2*a* is not smooth due to the presence of some large foreign substances and small foreign substances, if the ink jetting surface 2*a* is first wiped by the third wiping member 33 of the smaller surface roughness, and then wiped by the second wiping member 32 and first wiping member 31 of the greater surface roughness than the third wiping member 33, then some small foreign substances hidden behind some large foreign substances may not be removed by the second wiping member 32 or the first wiping member 31. In this respect, in this embodiment, the first wiping member 31, second wiping member 32, and third wiping member 33 is aligned in order from the left side, that is, from the downstream side in the first wiping direction in which the wiping unit 5 moves. Hence, by the wiping of the first wiping member 31 having the first rough surface 31*a* of the greatest surface roughness, the large foreign substances are removed from the ink jetting surface 2*a* at first, and after that, the second wiping member 32 and third wiping member 33 carry out the wiping. Therefore, it becomes easier to remove both the large foreign substances and the small foreign substances.

Further, among the three wiping members 31 to 33, if any of the rough surfaces 31*a* to 33*a* has a greater surface roughness, then it has a greater flexural rigidity. That is, the flexural rigidity of the first wiping member 31 is greatest, and the flexural rigidity of the second wiping member 32 is greater than that of the third wiping member 33. If the first wiping member 31 for removing large foreign substances has a great flexural rigidity, then it is less bendable in wiping and thus is strongly pressed against the ink jetting surface 2*a*. Therefore, the first wiping member 31 is able to wipe away and remove large foreign substances with a strong force.

Further, not being in contact with the ink jetting surface 2*a* (see FIG. 2), the three wiping members 31 to 33 are inclined to the left side with respect to the up-down direction orthogonal to the ink jetting surface 2*a*. Hence, when moving leftward in the first wiping operation as shown in FIG. 8A, the leading ends of the three wiping members 31 to 33 are in contact with the ink jetting surface 2*a* in a hung-up manner. By moving the three wiping members 31 to 33 in this state, it is possible to remove the foreign substances from the ink jetting surface 2*a* in a scrape-off manner.

<Second Wiping Operation>

Figure 8B:
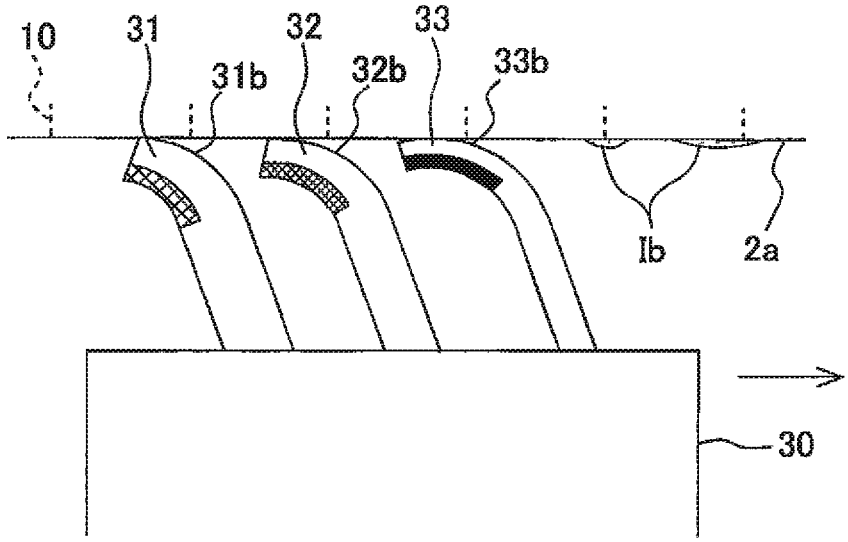

Next, an explanation will be given about a second wiping operation of the wiping unit 5 to remove the ink adhered to the ink jetting surface 2*a*. The control unit 6 controls the wiping motor 13 to move the wiping unit 5 to the opposite side from the first wiping direction in the paper width direction (the right side; also referred to as second wiping direction). Then, as shown in FIGS. 7 and 8B, the three wiping members 31 to 33 are each flexed, and the right lateral surfaces of their leading ends are in contact with the ink jetting surface 2*a*. Remaining in this state, the wiping unit 5 is moved in the second wiping direction along the ink jetting surface 2*a*.

The first smooth surface 31*b*, second smooth surface 32*b* and third smooth surface 33*b* of small surface roughness are formed in right lateral surfaces of the three wiping members 31 to 33, respectively. Thus, by contact with the ink jetting surface 2*a*, the three smooth surfaces 31*b* to 33*b* remove ink Ib adhered to the ink jetting surface 2*a*. Further, especially right after the purge is carried out, meniscuses in the plurality of nozzles 10 are in a disorganized state. However, as the smooth surfaces 31*b* to 33*b* of small surface roughness wipe the ink jetting surface 2*a*, it is possible to reorganize the meniscuses in the plurality of nozzles 10. Further, because the three smooth surfaces 31*b* to 33*b* wipe the ink jetting surface 2*a* three times successively, it is possible to prevent leaving any ink not wiped away.

Further, not being in contact with the ink jetting surface 2*a* (see FIG. 2), the three wiping members 31 to 33 are inclined to the left side with respect to the up-down direction. Hence, when moving rightward in the second wiping operation, it is easier for the leading ends of the three wiping members 31 to 33 to move along the ink jetting surface 2*a*. Therefore, it becomes easier for each of the three wiping members 31 to 33 to move smoothly along the ink jetting surface 2*a*.

Further, in the aforementioned first wiping operation, it is preferable for the wiping unit 5 to move at a comparatively low speed. When foreign substances such as paper powder and the like are stuck in the nozzles 10, if the wiping unit 5 moves at a high speed, then the foreign substances may be torn apart, and thus some of the foreign substances may remain in the nozzles 10. Therefore, it is preferable for the control unit 6 to control the wiping motor 13 such that the wiping unit 5 may move at a lower speed in the first wiping operation for removing the foreign substances than in the second wiping operation for wiping away the ink.

Further, if the wiping unit 5 carries out only the first wiping operation of FIG. 6, then it is preferable for the wiping unit 5 to return, after moving leftward while carrying out the first wiping operation, to the standby position on the right side without causing the wiping members 31 to 33 to contact with the ink jetting surface 2*a*. Further, if the wiping unit 5 carries out only the second wiping operation of FIG. 7, then it is preferable for the wiping unit S to move, before carrying out the second wiping operation, to the left side without causing the wiping members 31 to 33 to contact with the ink jetting surface 2*a*. In order to move the wiping unit 5 leftward and rightward in this manner without causing the wiping members 31 to 33 to contact with the ink jetting surface 2*a*, the elevating motor (see FIG. 3) may be used to lower the wiping members 31 to 33 down to such a position that their leading ends do not contact with the ink jetting surface 2*a*.

However, while it is possible to individually carry out either one of the first wiping operation for foreign substance removal and the second wiping operation for ink removal depending on the purpose as described above, the wiping unit 5 may also be moved reciprocatingly in the paper width direction to carry out both wiping operations continuously, an example of which will be given as follows.

Figure 9:
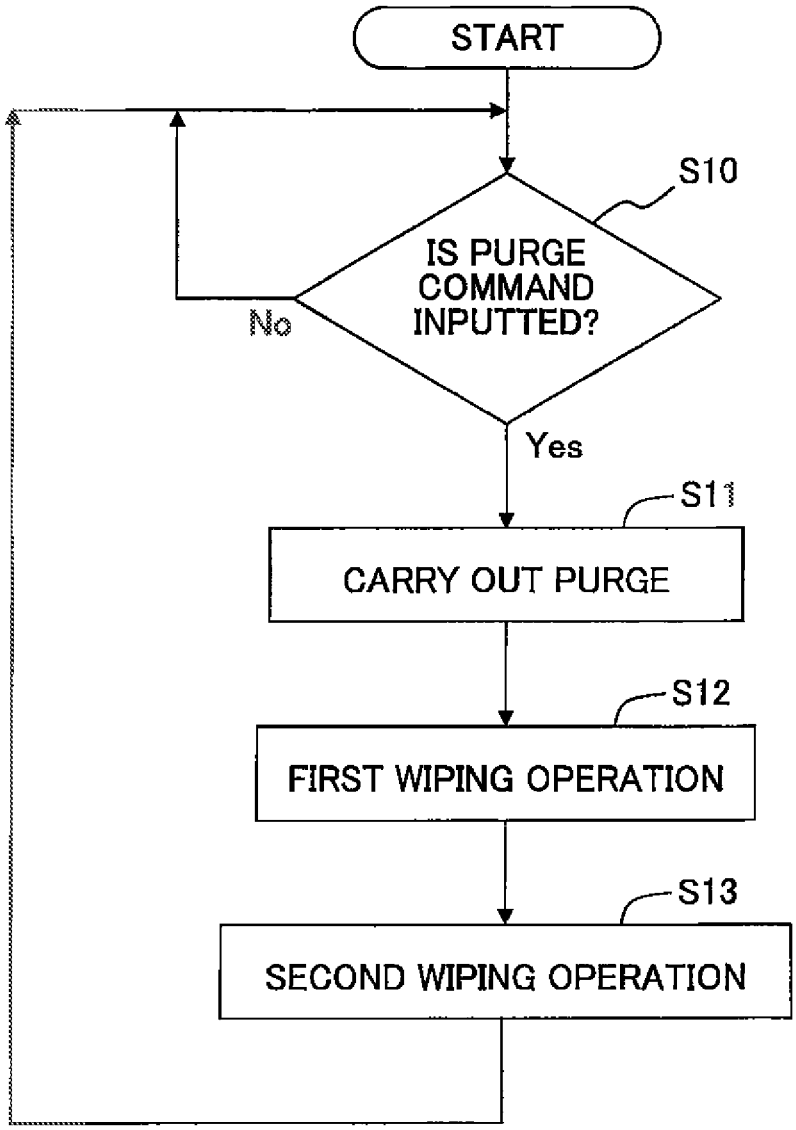
FIG. 9 is a flowchart of a maintenance process.

The following example is given to show that the wiping unit 5 is caused to carry out the first and second wiping operations as one step of the maintenance process for the ink jet head 2 including the aforementioned purge. Further, in FIG. 9, Si (i=10, 11, 12, and 13) denotes the step number of each step.

This maintenance process is consistently carried out while the printer 1 is powered on, and the control unit 6 stands by in a state of waiting for a purge command to be inputted (S10). When there is any indistinctness in an image printed on the recording paper 100, etc., if a user manipulates the operation panel 24 to input the purge command to the control unit 6 (S10: Yes), then the control unit 6 first controls the purge pump 11 to carry out the purge (S11). Further, the purge command mentioned here is not limited to a command inputted by the user. For example, it may also be a command for a scheduled purge to be carried out automatically whenever a certain period of time passes.

On the one hand, if a jetting defection of the nozzles 10 is caused by some air mixed into, and/or some thickened ink dried in, ink flow passages inside the ink jet head 2, then it is possible to eliminate the jetting defection through the purge by discharging the air and/or thickened ink from the nozzles 10. However, when foreign substances such as paper powder and the like are stuck in the nozzles 10, it may also cause a jetting defection. Paper powder is long paper fiber, and may sometimes enter deeply into the nozzles 10. In such cases, it is not easy to discharge the foreign substances such as paper powder and the like through the purge, and it is also possible that the jetting defection is not eliminated even though the purge is carried out many times.

Therefore, after the aforementioned purge, the control unit 6 controls the wiping motor 13 to move the wiping unit 5 in the first wiping direction so as to carry out the first wiping operation. Through this first wiping operation, the foreign substances such as paper powder and the like are removed by wiping the ink jetting surface 2*a* successively with each of the rough surfaces 31*a* to 33*a* of the three wiping members 31 to 33.

However, if the ink jetting surface 2*a* is wiped with the rough surfaces 31*a* to 33*a* of large surface roughness, then it is possible to disorganize the meniscuses of the ink jetting surface 2*a* inside the nozzles M. If printing is carried out with the meniscuses being disorganized in the nozzles 10, then the ink-jetting from the nozzles 10 becomes unstable, thereby reducing the print quality. Further, if the ink jetting surface 2*a* is wiped with the rough surfaces 31*a* to 33*a* of large surface roughness, then it is not possible to sufficiently wipe away the ink adhering to the ink jetting surface 2*a* through the purge.

Therefore, after the first wiping operation is finished, the control unit 6 controls the wiping motor 13 to rotate inversely and thus moves the wiping unit 5 in the second wiping direction to carry out the second wiping operation. Through this second wiping operation, by wiping the ink jetting surface 2*a* successively with each of the smooth surfaces 31*b* to 33*b* of the three wiping members 31 to 33, the meniscuses in the nozzles 10 are reorganized while the ink adhering to the ink jetting surface 2*a* is wiped away.

In this embodiment as described above, by controlling the wiping motor 13, the control unit 6 causes the wiping unit 5 to carry out the first wiping operation and the second wiping operation. That is, the wiping motor 13 and the control unit 6 controlling the wiping motor 13 correspond to the "drive section" of the present invention. Further, it is also possible to switch the wiping operations of the wiping unit 5 without the process by the control unit 6. For example, it is possible to switch the wiping operations of the wiping unit 5 by an appropriate switching mechanism constructed of gears and the like provided between the wiping motor 13 and the wiping unit 5.

Next, explanations will be given about a few modifications applying various changes to the above embodiment. Note that, however, the same reference numerals are assigned to the Members having identical or similar configurations to those of the above embodiment, any explanation of which will be omitted as appropriate.

[Modification 1]

It is possible to appropriately change the number, arrangement, shape and the like of the wiping members of the wiping unit 5. For example, the number of the wiping members is not limited to three, but may also be two or more than three.

Figure 10A:
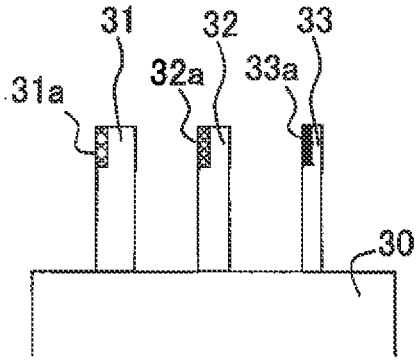
FIGS. 10A to 10E are lateral views of the wiping members of the wiping unit according to modifications.

As shown in FIG. 10A, each of the wiping members 31 to 33 may also extend in the up-down direction orthogonal to the plane including the ink jetting surface 2*a*.

Further, in order to most strongly press the first wiping member 31 having the first rough surface 31*a* of great surface roughness against the ink jetting surface 2*a*, other than varying the flexural rigidity of the wiping members exemplified in the above embodiment, such configurations as follows are also possible.

Figure 10B:
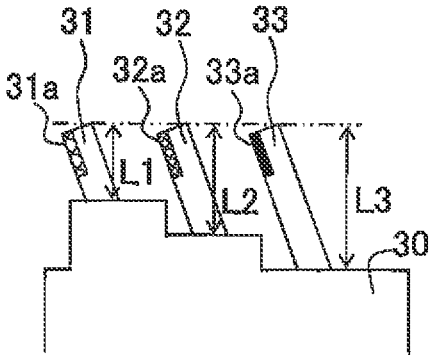

Between the plurality of wiping members, it is possible to vary the length of the deformable portions which are deformed when pressed against the ink jetting surface 2*a*. In FIG. 10B for example, although the leading ends of the three wiping members 31 to 33 are positioned at the same position, the three wiping members 31 to 33 not only vary from each other in the length of their own, but also vary in the attachment position to the holding member 30 in the up-down direction. That is, let L1 be the length of the deformable portion of the first wiping member 31 in the up-down direction, L2 be the length of the deformable portion of the second wiping member 32 in the up-down direction, and L3 be the length of the deformable portion of the third wiping member 33 in the up-down direction. Then, it turns out that L1<L2<L3.

Figure 10C:
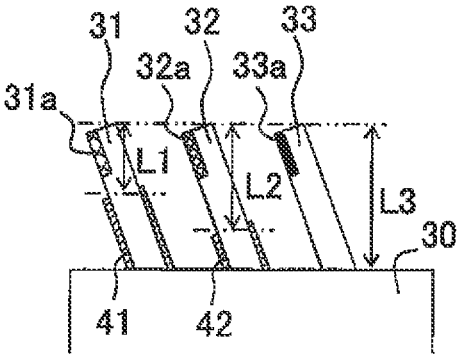

Alternatively, restraint members may be attached to base end portions of the wiping members to restrain the base end portions from deformation. In FIG. 10C, for example, the three wiping members 31 to 33 have the same length of each other, and their leading ends are positioned at the same position in the up-down direction. On base end portions of the first wiping member 31 and second wiping member 32, restraint members 41 and 42 formed of metallic plates or the like are attached to sandwich the wiping members 31 and 32 in their thickness direction, respectively. Therefore, the restraint members 41 and 42 restrain the base end portions of the first wiping member 31 and second wiping member 32 from deformation, respectively. Here, the restraint members 41 attached to the first wiping member 31 are longer than the restraint members 42 attached to the second wiping member 32. By virtue of this, the length L1 of the deformable portion of the first wiping member 31 (the portion on which the restraint members 41 are not fitted) is shorter than the length L2 of the deformable portion of the second wiping member 32, and shorter than the length L3 of the deformable portion of the third wiping member 33.

As shown above in FIGS. 10B and 10C, if the deformable portion of the first wiping member 31 is short, then the first wiping member 31 is less bendable, and thus the leading end of the first wiping member 31 is strongly pressed against the ink jetting surface 2*a*. Therefore, the first wiping member 31 is able to wipe away and remove large foreign substances with a strong force.

Figure 10D:
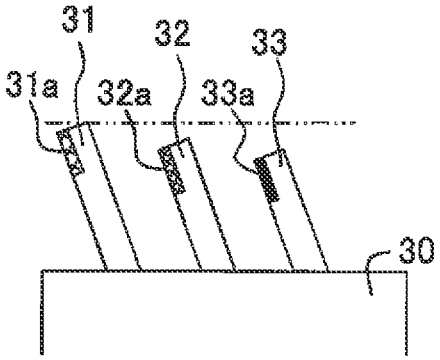

Further, as shown in FIG. 10D, the three wiping members 31 to 33 may be attached to the same attachment height of the holding member 30, but the leading ends may be positioned at different positions in the up-down direction. Further, the leading end of the first wiping member 31 has a higher position than the second wiping member 32 and the third wiping member 33 such that when in contact with the ink jetting surface 2*a*, the first wiping member 31 may be most strongly pressed against the ink jetting surface 2*a* to remove large foreign substances.

Figure 10E:
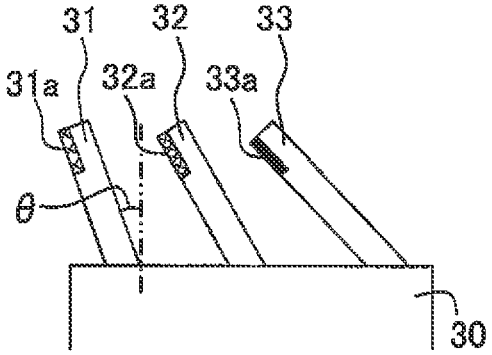

Further, as shown in FIG. 10E, the three wiping members 31 to 33 may also vary in inclination. Large foreign substances adhere more firmly to the ink jetting surface 2*a* than small foreign substances, and thus need a stronger force to act for removal. In this respect, if the wiping members have a smaller inclination angle θ to the up-down direction (vertical direction) orthogonal to the ink jetting surface 2*a*, that is, if the wiping members are in a more upright posture, then the leading ends of the wiping members contact with the foreign substances in a cut-into manner, and thus it is conceivable to have a high effect in removing the foreign substances. From this point of view, as shown in FIG. 10E, it is preferable that the first wiping member 31 for removing large foreign substances has the smallest inclination angle θ to the up-down direction, and the second wiping member 32 and the third wiping member 33 have large inclination angles θ in ascending order.

Further, the three wiping members 31 to 33 need not be arranged at equally spaced intervals, but the interval between the wiping members 31 and 32 may vary appropriately from the interval between the wiping members 32 and 33. For example, from the point of view of preventing the large foreign substances removed by the first wiping member 31 from adhering to the adjacent second wiping member 32, the interval between the first wiping member 31 and the second wiping member 32 may be greater than the interval between the second wiping member 32 and the third wiping member 33. Further, although it is possible to lengthen all intervals between the three wiping members 31 to 33, lengthening the intervals results in enlarging the wiping unit at that rate. Hence, it is preferable to lengthen the interval only for the necessary place as in the abovementioned configuration.

[Modification 2]

The plurality of wiping members are not necessarily connected but may be separated. In such a case, however, because it is necessary for the drive section to move the plurality of wiping members individually, the configuration of the drive section becomes somewhat complicated.

[Modification 3]

Figure 11A:
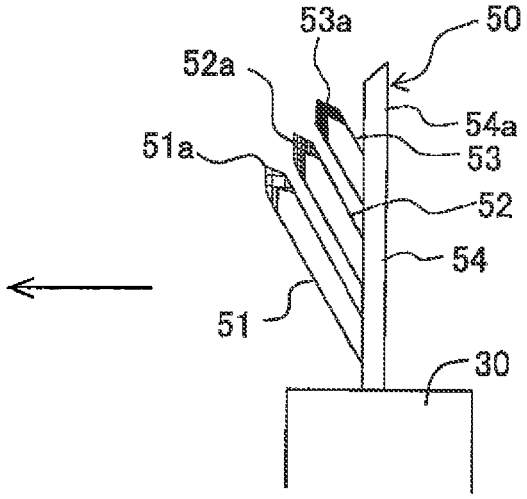
FIGS. 11A to 11C are lateral views of wiping members of the wiping unit according to another modification.

The plurality of wiping members each having a rough surface may also be formed integrally by one member. As shown in FIG. 11A, for example, a wiping member 50 is formed by an elastic member such as rubber. This wiping member 50 has a deformable main body portion 54 which extends in the up-down direction, and a first wiping portion 51, a second wiping portion 52 and a third wiping portion 53 each of which extends obliquely upward as a branch from one lateral surface of the deformable main body portion 54. The three wiping portions 51, 52 and 53 are supported by the deformable main body portion 54 such that their respective leading ends may be arranged at intervals in the left-right direction. A first rough surface 51*a*, a second rough surface 52*a* and a third rough surface 53*a* are provided as the entire surfaces of the leading ends of the three wiping portions 51, 52 and 53, respectively. On the other hand, a smooth surface 54*a* of a smaller surface roughness than the rough surfaces 51*a*, 52*a* and 53*a* is provided as the other surface of the deformable main body portion 54 on the opposite side from the three wiping portions 51, 52 and 53.

Figure 11B:
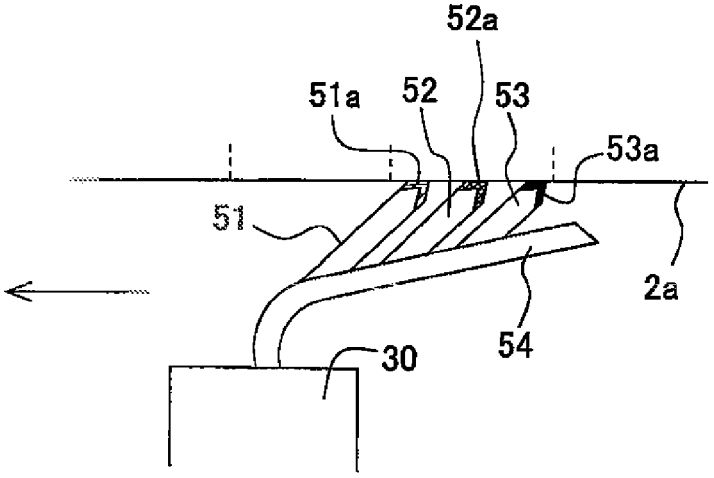
Figure 11C:
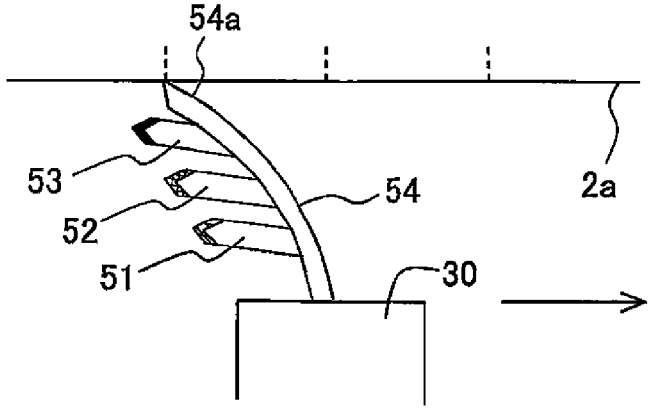

As shown in FIG. 11B, when moving leftward, this wiping member 50 wipes the ink jetting surface 2*a* with each of the rough surfaces 51*a* to 53*a* of the three wiping portions 51 to 53 to remove the foreign substances on the ink jetting surface 2*a*. On the other hand, as shown in FIG. 11C, when moving rightward, it wipes the ink jetting surface 2*a* with the smooth surface 54*a* of the deformable main body portion 54 to remove the ink on the ink jetting surface 2*a*. Further, the three wiping portions 51 to 53 are pressed against the ink jetting surface 2*a* more strongly and thus flexed more deeply in FIG. 11B than in FIG. 11C. In order to achieve such a state, the elevating motor (see FIG. 3) may be used to adjust the up-down position of the wiping member 50 so as to change the distance between the three wiping portions 51 to 53 and the ink jetting surface 2*a* in reference to FIG. 11B and FIG. 11C.

[Modification 4]

The wiping unit 5 may also be a dedicated device for removing the foreign substances adhering to the ink jetting surface 2*a*. In such a case, because the wiping unit 5 does not wipe away the ink on the ink jetting surface 2*a*, it is not necessary to provide the wiping portions with the smooth surfaces for wiping away the ink.

[Modification 5]

In the above embodiment, there is exemplified a configuration of wiping the ink jetting surface 2*a* by moving the wiping unit 5 relative to the ink jet head 2. However, it is also configurable to move the ink jet head 2 relative to the wiping unit 5. Further, it is also configurable to move both the ink jet head 2 and the wiping unit 5.

For example, if the ink jet head is a so-called serial head which is mounted on a carriage moving in the paper width direction to jet ink while moving in the paper width direction, then it is possible to cause a wiping unit to wipe the ink jetting surface by moving the ink jet head relative to the wiping unit provided fixedly on the printer.

[Modification 6]

There are certain types of foreign substances which are more likely to emerge with a longer duration of using a printer. For example, while paper power is scattered from the recording paper 100 being transported, for the reason that the surfaces of the transport rollers 3 and 4 become roughened due to aged deterioration, etc., it is conceivable that the amount of emergence of paper power increases as the printer 1 is used for a longer time. Further, in the first wiping operation for removing foreign substances, because the wiping portions are strongly pressed against the ink jetting surface 2*a* to be wiped, if the first wiping operation is carried out too often, then the ink jetting surface 2*a* is liable to be roughened. If the ink jetting surface 2*a* is roughened, then ink repellency of the ink jetting surface 2*a* becomes low. Thereby, the ink jetting surface 2*a* becomes more likely to be soaked with the ink, and thus it becomes difficult to remove the ink adhering to the ink jetting surface 2*a* through the second wiping operation. Hence, in the initial stage of using the printer 1 where foreign substances such as paper powder and the like are less likely to adhere, it is preferable not to carry out the unnecessary first wiping operation.

Therefore, the control unit 6 may decide whether or not to let the wiping unit 5 carry out the first wiping operation according to how long the printer 1 is used. For example, the control unit 6 may first count the total number of printed sheets of the recording paper 100 so far, and then causes the wiping unit 5 to carry out the first wiping operation if the total number of printed sheets exceeds a predetermined number of sheets.

[Modification 7]

If the printer has an alteration means for altering a relative position relation in the up-down direction between the wiping portions of the wiping unit 5, and the ink jetting surface 2*a* of the ink jet head 2, then it is possible to alter the strength of pressing the wiping portions against the ink jetting surface 2*a*. Further, the above alteration means may either move the wiping portions of the wiping unit 5 relative to the ink jet head 2 in a direction orthogonal to the ink jetting surface 2*a* in the same manner as the elevating motor in the above embodiment or, conversely, move the ink jet head 2 relative to the wiping unit 5 in the above orthogonal direction.

For example, while it is preferable to press the wiping portions strongly against the ink jetting surface 2*a* in the first wiping operation for removing the foreign substances, it is not necessary to press the wiping portions so strongly against the ink jetting surface 2*a* in the second wiping operation for wiping away the ink. Therefore, it is also possible to let the wiping portions come closer to the ink jetting surface 2*a* in the first wiping operation than in the second wiping operation.

Further, if the wiping portions are, pressed strongly against the ink jetting surface 2*a* continuously in the first wiping operation, then the ink jetting surface 2*a* is liable to be roughened at an early date. Therefore, it is also possible to first set a longer distance between the wiping portions and the ink jetting surface 2*a* in the initial stage of utilization, and then let the wiping portions come closer to the ink jetting surface 2*a* for a longer duration of using the printer.

In the above embodiment and its modifications explained above, the present invention is applied to an ink jet printer which jets ink onto sheets of recording paper to print images and the like. However, it is also possible to apply the present invention to any liquid jetting apparatuses used for various purposes other then printing images and the like. For example, it is also possible to apply the present invention to a liquid jetting apparatus which jets an electrically conductive liquid to a substrate to form a conductive pattern on a surface of the substrate.

What is claimed is:

1. A liquid jetting apparatus comprising:

a liquid jetting head having a liquid jetting surface in which a nozzle is formed;

a wiping unit configured to wipe the liquid jetting surface of the liquid jetting head; and a drive section configured to move at least one of the wiping unit and the liquid jetting head such that the wiping unit moves relative to the liquid jetting head toward one side in a predetermined direction along the liquid jetting surface, wherein the wiping unit has a first wiping portion and a second wiping portion which are arranged in the predetermined direction with an interval therebetween, and each of which has a leading end configured to contact with the liquid jetting surface and extends in a direction intersecting the liquid jetting surface, wherein the leading end of the first wiping portion has a greater surface roughness than that of the leading end of the second wiping portion, and wherein the leading end of the first wiping portion has a first rough surface facing the one side in the predetermined direction and a first smooth surface facing the other side in the predetermined direction and having a surface roughness smaller than that of the first rough surface, the leading end of the second wiping portion has a second rough surface facing the one side in the predetermined direction and having a surface roughness smaller than that of the first rough surface and greater than that of the first smooth surface and a second smooth surface facing the other side in the predetermined direction and having a surface roughness smaller than that of the second rough surface, and the drive section is configured to move the wiping unit relative to the liquid jetting surface to the one side in the predetermined direction in a state that the first rough surface of the first wiping portion and the second rough surface of the second wiping portion are in contact with the liquid jetting surface, and thereafter, move the wiping unit relative to the liquid jetting surface to the other side in the predetermined direction in a state that the first smooth surface of the first wiping portion and the second smooth surface of the second wiping portion are in contact with the liquid jetting surface.

2. The liquid jetting apparatus according to claim 1, wherein the first wiping portion and the second wiping portion are arranged from the one side in the order of the first wiping portion to the second wiping portion.

3. The liquid jetting apparatus according to claim 1, wherein the first wiping portion has a flexural rigidity greater than that of the second wiping portion.

4. The liquid jetting apparatus according to claim 1, wherein the wiping unit has a connection portion configured to connect the first wiping portion and the second wiping portion integrally.

5. The liquid jetting apparatus according to claim 1, wherein an inclination angle of the first wiping portion with respect to a vertical direction orthogonal to the liquid jetting surface is different from an inclination angle of the second wiping portion with respect to the vertical direction.

6. The liquid jetting apparatus according to claim 5, wherein the inclination angle of the first wiping portion with respect to the vertical direction is smaller than the inclination angle of the second wiping portion with respect to the vertical direction.

7. The liquid jetting apparatus according to claim 1, wherein the first wiping portion is longer than the second wiping portion, and the wiping unit is configured such that the base end of the first wiping portion and the base end of the second wiping portion are positioned at the same position with respect to a vertical direction orthogonal to the liquid jetting surface.

8. The liquid jetting apparatus according to claim 1, wherein in a state that the leading end of each of the first wiping portion and the second wiping portion is not in contact with the liquid jetting surface, each of the first wiping portion and the second wiping portion is inclined with respect to a vertical direction orthogonal to the liquid jetting surface.

9. The liquid jetting apparatus according to claim 1, wherein the wiping unit further includes a deformable main body portion configured to support the first wiping portion and the second wiping portion, and the first wiping portion and the second wiping portion are supported by the deformable main body portion such that the leading end of the first wiping portion and the leading end of the second wiping portion are arranged in the predetermined direction with an interval therebetween.

10. The liquid jetting apparatus according to claim 1, wherein each of the first rough surface and the second rough surface has a plurality of projections projecting toward the one side in the predetermined direction, and each of the intervals between the adjacent projections in the first rough surface is greater than each of the intervals between the adjacent projections in the second rough surface.

11. A liquid jetting apparatus comprising:

a liquid jetting head having a liquid jetting surface in which a nozzle is formed;

a wiping unit configured to wipe the liquid jetting surface of the liquid jetting head; and a drive section configured to move at least one of the wiping unit and the liquid jetting head such that the wiping unit moves relative to the liquid jetting head toward one side in a predetermined direction along the liquid jetting surface, wherein the wiping unit has a first wiping portion and a second wiping portion which are arranged in the predetermined direction with an interval therebetween, and each of which has a leading end configured to contact with the liquid jetting surface and extends in a direction intersecting the liquid jetting surface, wherein the leading end of the first wiping portion has a greater surface roughness than that of the leading end of the second wiping portion, and wherein the first wiping portion has a first deformable portion capable of flexural deformation on a side of the leading end thereof, the second wiping portion has a second deformable portion capable of flexural deformation on a side of the leading end thereof, and the first deformable portion is shorter in length than the second deformable portion, and wherein the first wiping portion has a first restraint member configured to restrain the first wiping portion from flexural deformation on a side of a base end thereof, the second wiping portion has a second restraint member configured to restrain the second wiping portion from flexural deformation on a side of a base end thereof, and the first restraint member is longer than the second restraint member.

12. A liquid jetting apparatus comprising;

a liquid jetting head having a liquid jetting surface in which a nozzle is formed;

a wiping unit configured to wipe the liquid jetting surface of the liquid jetting head; and a drive section configured to move at least one of the wiping unit and the liquid jetting head such that the wiping unit moves relative to the liquid jetting head toward one side in a predetermined direction along the liquid jetting surface, wherein the wiping unit has a first wiping portion and a second wiping portion which are arranged in the predetermined direction with an interval therebetween, and each of which has a leading end configured to contact with the liquid jetting surface and extends in a direction intersecting the liquid jetting surface, and the leading end of the first wiping portion has a greater surface roughness than that of the leading end of the second wiping portion, and wherein the first wiping portion has a first deformable portion capable of flexural deformation on a side of the leading end thereof, the second wiping portion has a second deformable portion capable of flexural deformation on a side of the leading end thereof, and the first deformable portion is shorter in length than the second deformable portion, and wherein the wiping unit further comprises a holding member configured to hold the first wiping portion and the second wiping portion, the first wiping portion is shorter than the second wiping portion, and the first wiping portion and the second wiping portion are attached to the holding member at different positions with respect to a vertical direction orthogonal to the liquid jetting surface such that the leading end of the first wiping portion and the leading end of the second wiping portion are positioned at the same position with respect to the vertical direction.

* * * * *